US009273454B2

(12) United States Patent
Slawinski

(10) Patent No.: US 9,273,454 B2
(45) Date of Patent: Mar. 1, 2016

(54) BIDET SYSTEM AND METHODS THEREFOR

(76) Inventor: Michael F. Slawinski, Dyer, IN (US)

( * ) Notice: Subject to any disclaimer, the term of this patent is extended or adjusted under 35 U.S.C. 154(b) by 913 days.

(21) Appl. No.: 13/535,653

(22) Filed: Jun. 28, 2012

(65) Prior Publication Data

US 2013/0000029 A1 Jan. 3, 2013

Related U.S. Application Data

(60) Provisional application No. 61/571,432, filed on Jun. 28, 2011.

(51) Int. Cl.
*E03D 9/08* (2006.01)

(52) U.S. Cl.
CPC . *E03D 9/08* (2013.01); *Y10T 29/494* (2015.01)

(58) Field of Classification Search
CPC ..... E03D 9/08; E03D 9/085
USPC ..... 4/420.1, 420.2, 420.4
See application file for complete search history.

(56) References Cited

U.S. PATENT DOCUMENTS

| | | | | |
|---|---|---|---|---|
| 2,344,561 | A | 3/1944 | Popil | |
| 2,504,257 | A | 4/1950 | Dunn | |
| 2,774,078 | A | 12/1956 | Pazos | |
| 2,872,687 | A | 2/1959 | Maurer | |
| 2,995,759 | A | 8/1961 | Gentry | |
| 3,256,531 | A | 6/1966 | Arensberg | |
| 3,513,487 | A | 5/1970 | Palermo et al. | |
| 3,577,567 | A | 5/1971 | Wintercorn | |
| 3,781,919 | A | 1/1974 | Ayala | |
| 4,069,519 | A | 1/1978 | Alexander | |
| 4,135,255 | A | 1/1979 | Menendez | |
| 4,926,509 | A * | 5/1990 | Bass | 4/448 |
| 4,995,121 | A | 2/1991 | Barker | |
| 5,210,885 | A | 5/1993 | Ruo | |
| 5,384,919 | A | 1/1995 | Smith | |
| 5,431,187 | A | 7/1995 | Nee | |
| 5,566,402 | A | 10/1996 | Agha el-Rifai et al. | |
| 5,572,748 | A | 11/1996 | Nee | |
| 5,722,097 | A * | 3/1998 | Deveer | 4/420.4 |
| 5,799,341 | A | 9/1998 | Rodas | |
| 5,809,585 | A | 9/1998 | Farshad | |
| 5,839,129 | A | 11/1998 | Lee | |
| 5,943,707 | A | 8/1999 | Bergenwall | |
| 6,192,527 | B1 | 2/2001 | Paul | |
| 6,526,602 | B2 | 3/2003 | Jeon | |
| 7,013,502 | B2 | 3/2006 | Pacheco | |
| 2003/0163864 | A1 * | 9/2003 | Haan | 4/420.4 |

* cited by examiner

*Primary Examiner* — Huyen Le
(74) *Attorney, Agent, or Firm* — Hartman Global IP Law; Gary M. Hartman; Michael D. Winter

(57) ABSTRACT

A bidet system comprising an adaptor assembly, handle assembly, and attachment assembly. The adaptor assembly is adapted to be connected to a water system or other suitable liquid supply, and delivers liquid to the bidet system. The handle assembly allows a user to manipulate the flow and pressure of liquid to a discharge nozzle of the handle system. The attachment assembly is adapted to fix the handle assembly to a toilet.

12 Claims, 4 Drawing Sheets

BIDET SYSTEM AND METHODS THEREFOR

This application claims the benefit of U.S. Provisional Application No. 61/571,432, filed Jun. 28, 2011, the contents of which are incorporated herein by reference.

BACKGROUND OF THE INVENTION

The present invention generally relates to bidets, water closets and toilet systems. More particularly, this invention relates a bidet system adapted to be installed and used in combination with a toilet.

BRIEF DESCRIPTION OF THE INVENTION

The present invention provides a bidet system for installation and use with a toilet and a sink system.

According to a first aspect of the invention, the bidet system includes an adaptor assembly adapted to be fluidically connected to a liquid supply, a handle assembly fluidically coupled to the adapter assembly, and an attachment assembly adapted to mount the handle assembly to a toilet bowl. The handle assembly includes a device for controlling flow of a liquid delivered by the adaptor assembly to the handle assembly, a nozzle for discharging the liquid from the handle assembly, and a handle adapted to maneuver the nozzle. The attachment assembly is adapted to enable the nozzle of the handle assembly to be maneuvered within the toilet bowl. Additional aspects of the invention include methods of installing and using the bidet system.

A technical effect of the invention is the ability to adapt an otherwise conventional toilet to have at least some of the functionality of a bidet, and the ability to provide such a capability with a system that is relatively easy to install and operate.

Other aspects and advantages of this invention will be better appreciated from the following detailed description.

DETAILED DESCRIPTION OF THE INVENTION

Figure 3:
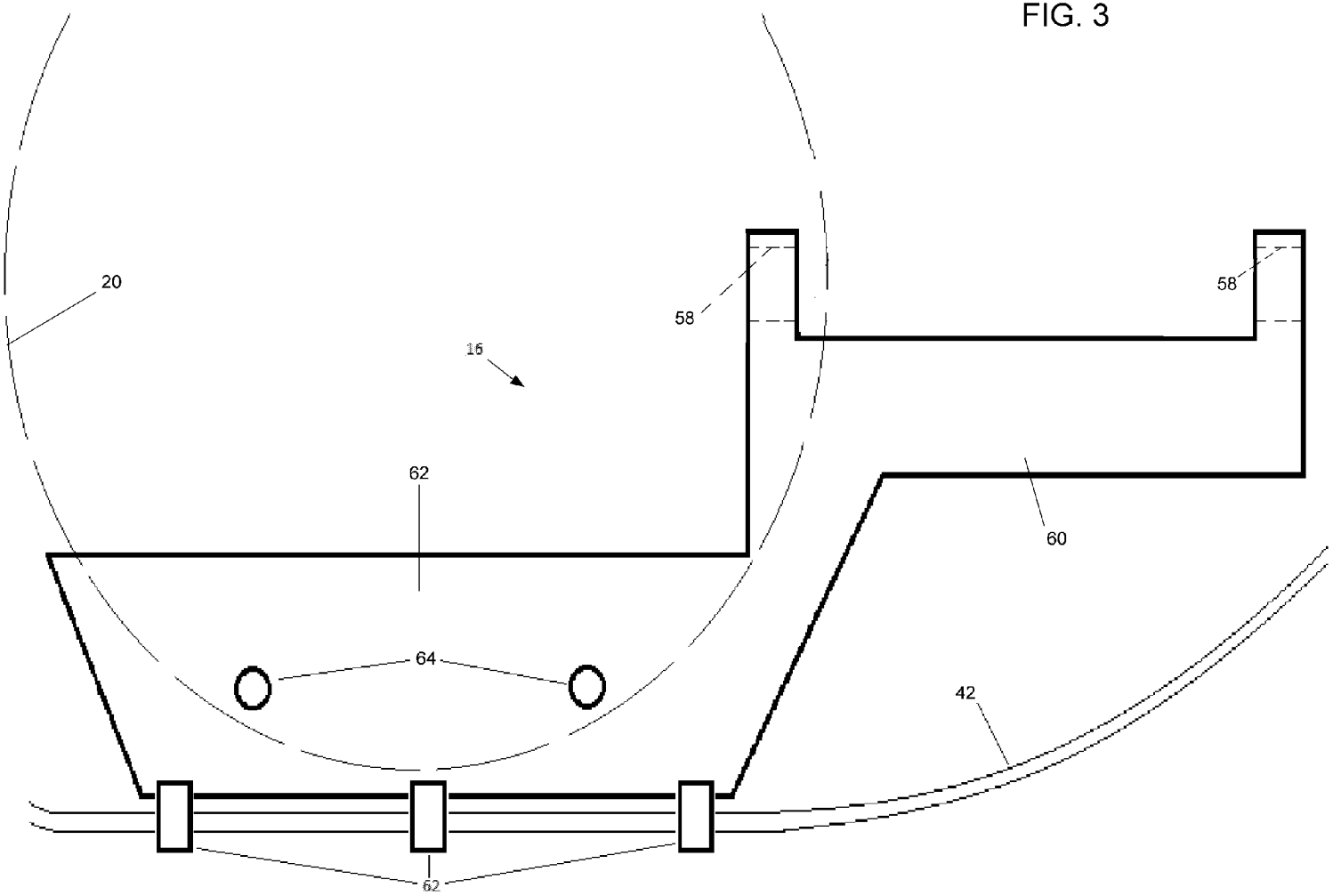
FIG. 3 schematically represents a top view of the attachment piece of FIG. 1.

FIGS. 1 through 4 represent preferred aspects of a bidet system 10 of the present invention. The bidet system 10 is represented as comprising an adaptor assembly 12, a handle assembly 14, and an attachment assembly 16. The adaptor assembly 12 is adapted to be connected to a supply of any suitable type of cleansing liquid, for example, the plumbing of a faucet system 18 underneath a bathroom sink, and transports water from the faucet system 18 to the bidet system 10. The adaptor assembly 12 connects to the handle assembly 14 so that water from the faucet system 18 is able to flow through the handle assembly 14 to a bidet nozzle 22, where the water is discharged within a toilet bowl 20 (FIG. 3). In addition, the handle assembly 14 is operable by a user to control the position and orientation of the nozzle 22 within the bowl 20, as well as the pressure and direction of water flow from the nozzle 22. The attachment piece 16 fixes the handle assembly 14 to the toilet bowl 20.

The adaptor assembly 12 is represented as comprising at least two adapters 26 inserted between shut off valves 28 and sink faucet connectors 30. By this method, the adaptor assembly 12 is able to make use of both hot and cold water from the faucet system 18. Tubing 32, such as polyethylene, connects the two adapters 26 to a tee pipe 34 by way of needle valves 36. The needle valves 36 provide a means for adjusting the pressure and temperature of water delivered from the faucet system 18 to the nozzle 22. The needle valves 36 and tee pipe 34 are hereafter referred to as a mixing assembly 40. It is foreseeable that other means could be employed to mix hot and cold water from a plumbing system, including devices having an automatic capability that allows the temperature of the mixed water to be set and controlled, and such alternatives are within the scope of the invention.

Figure 1:
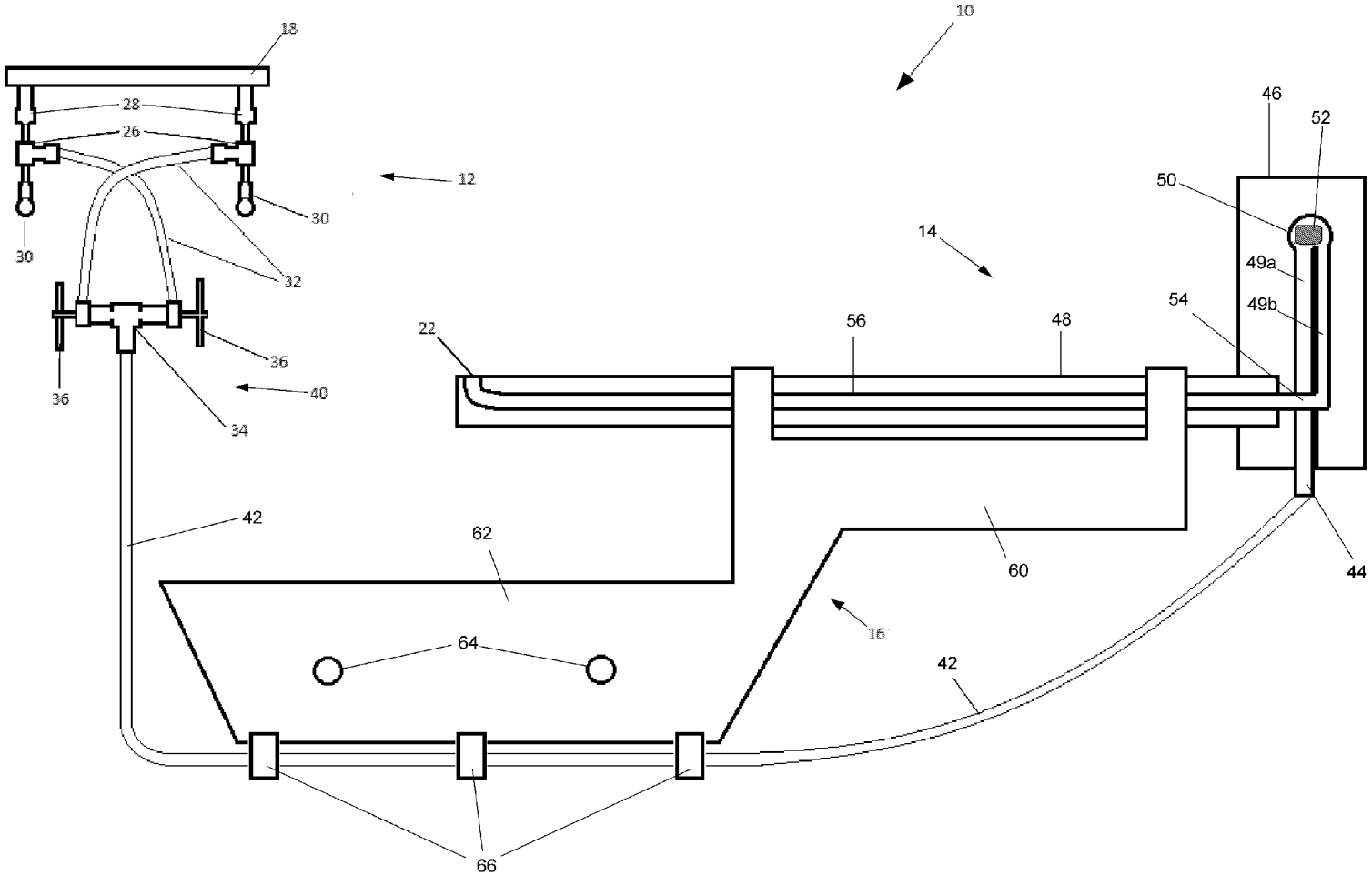
FIG. 1 schematically represents a top view of a bidet system comprising an adaptor assembly, handle assembly, and attachment piece in accordance with an embodiment of the invention.
Figure 2:
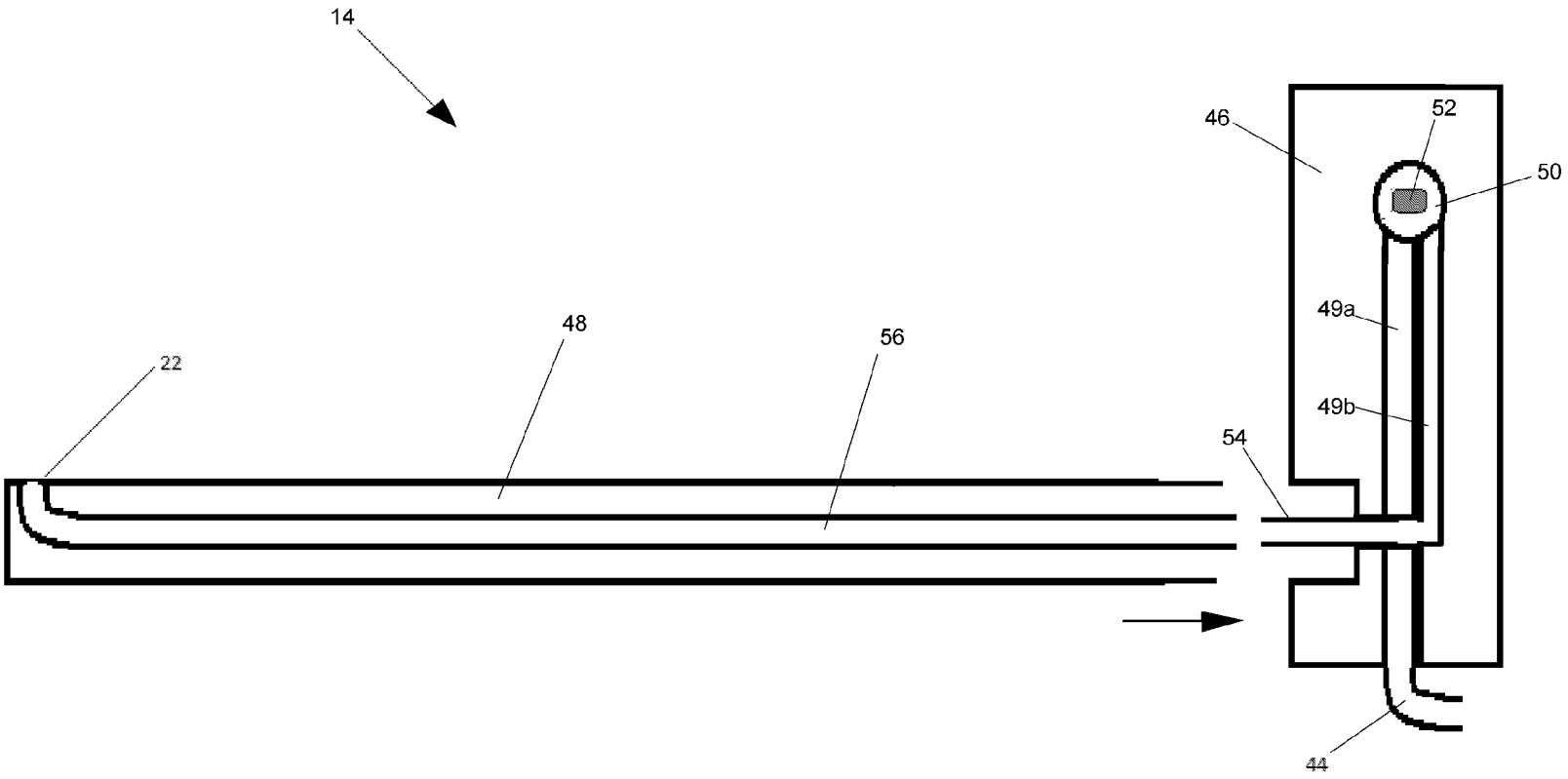
FIG. 2 schematically represents a top view of the handle assembly of FIG. 1.

The mixing assembly 40 is connected to the handle assembly 14 through another tube 42, shown as being directly connected to the handle assembly 14 in the embodiment of FIG. 1. The tube 42 is shown connected to the handle assembly 14 through an elbow connection 44 at one end of a handle 46 of the handle assembly 14. The elbow connection 44 is preferably on the same end of the handle 46 as the connection to a pipe 48 that is coupled to the handle 46 with a connector 54. The nozzle 22 is located at an end of the pipe 48 distal to the handle assembly 14.

The handle assembly 14 generally includes not only the handle 46, which may be formed, for example, of acrylic or other suitable composition, but also the pipe 48 coupled thereto by a connector 54. The pipe 48 may be formed of various materials, including PVC. The handle assembly 14 further includes a suitable valve means 50 capable of selectively allowing water flow from a passage 49*a* within the handle 46 connected to the tube 42 to a second passage 49*b* within the handle 46 that is connected to the pipe 48 via its connector 54. For this purpose, a button 52 is shown on the handle 46 by which a user can operate the valve means 50. The valve means 50 is preferably self-closing and, when pressed, allows water to pass through the handle 46 to the pipe 48. The pressure of the water is preferably controllable by adjusting the degree to which the button 52 is pressed. While a mechanical valve is suitable as the valve means 50, other methods for achieving this operating action could be used.

The connector 54 securing the pipe 48 to the handle 46 allows water to flow into a tubing 56 within the pipe 48, which delivers the water to the nozzle 22 at the end of the pipe 48 opposite the handle 46. The water is preferably discharged from the nozzle 22 as a single stream, though the invention is not limited in this regard. The nozzle 22 preferably does not protrude from the pipe 48 and the length of the tubing 56 is preferably entirely within the pipe 48, such that the intrusion of the bidet system 10 into the toilet bowl 20 is predominantly if not entirely the result of the outer profile of the pipe 48. The pipe 48 and handle 46 are preferably fixed to each other by the connector 54 (optionally any suitable alternative or additional means), such that one does not move relative to the other. As such, the user can manipulate the orientation of the pipe 48, and therefore the orientation of the nozzle 22 and its stream of water, by operating the handle 46.

In the embodiment represented in the figures, the handle assembly 14 is attached to the toilet bowl 20 by the manner in which the pipe 48 is coupled to the attachment piece 16. The handle assembly 14 is coupled to the attachment piece 16 by sliding the pipe 48 through holes 58 formed in a hinge member 60 of the attachment piece 16. The holes 58 define a pivot axis for the handle assembly 14. In this way, the handle assembly 14 is supported by the attachment piece 16, but is free to rotate about its pivot axis. In addition, the handle assembly 14 is also preferably capable of axial movement along its pivot axis, which in turn provides considerably maneuverability of the nozzle 22 within the toilet bowl 20. The holes 58 may be sized or provided with bushings (not shown) or other suitable means capable of providing a certain amount of friction or interaction with the pipe 48 to provide stability and resistance to movement.

The attachment piece 16 further comprises a rear spacer 62. The hinge member 60 and rear spacer 62 may be one solid piece or assembled, but are preferably fixed relative to each other. The rear spacer 62 is represented as having two holes 64 by which the entire attachment piece 16 and the handle assembly 14 coupled thereto can be secured to the toilet bowl 20, for example, between the bowl 20 and a toilet seat (not shown). The holes 64 can be sized and located to allow bolts (not shown) that secure a toilet seat to the bowl 20 to also be used to secure the attachment piece 16 to the bowl 20. The holes 64 may be spaced and sized for certain toilet models, though it is also possible that the size and spacing of the holes 64 could be adaptable for installation on a range of toilet configurations.

FIGS. 1 and 3 further show clamps 66 located on the rear edge of the rear spacer 62 to permit securement of the tubing 42 to the rear spacer 62, thereby providing further convenience and containment of the entire system 10. However, fixing the tube 42 to the rear spacer 62 is optional and not necessary for the operation of the system 10.

Figure 4:
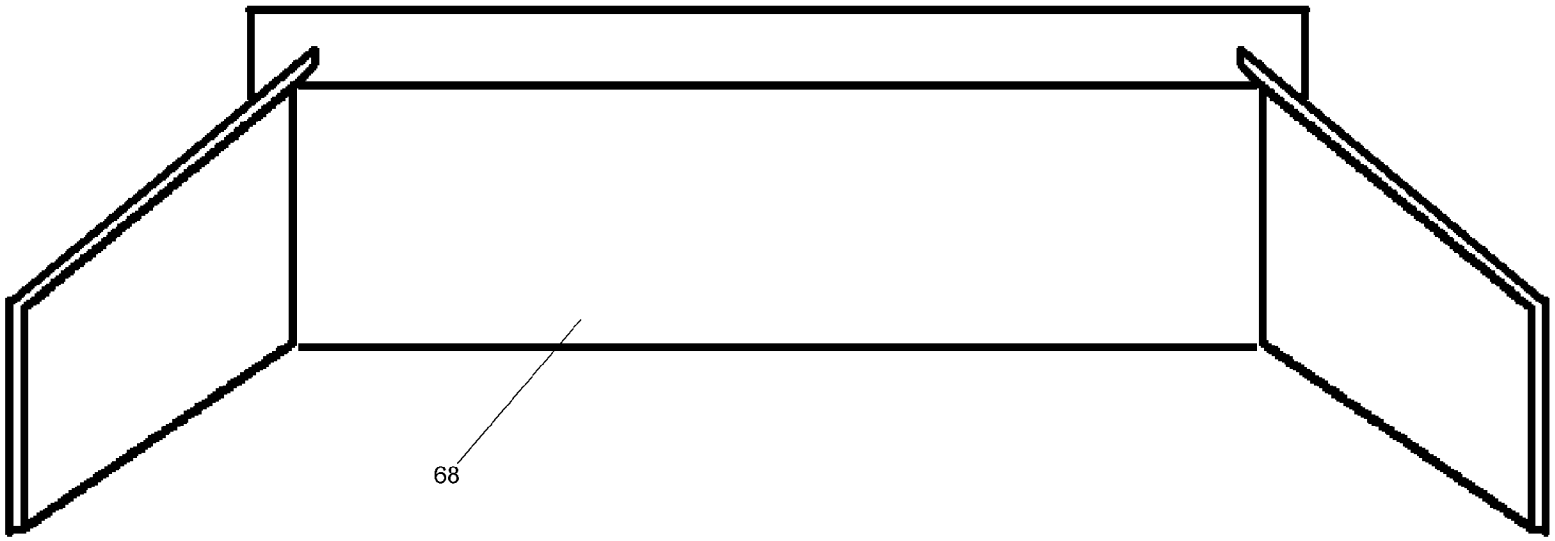
FIG. 4 schematically represents a top view of a bumper as an optional additional attachment to the bidet system of FIG. 1.

Because the rear spacer 62 tends to raise the toilet seat relative to the bowl 20, it may be desirable or necessary to provide a means for keeping the toilet seat level or to prevent toilet water from splashing out of the toilet bowl 20 between the bowl 20 and toilet seat. For this purpose, FIG. 4 represents a bumper shield 68 suitable for being secured, for example, with tape or other adhesive means, between the toilet bowl 20 and toilet seat at the front of the toilet bowl 20.

While the invention has been shown and described in terms of a specific embodiment, it is apparent that other forms could be adopted by one skilled in the art. For example, the physical configuration of the billet system 10 could differ from that schematically represented in the figures, and materials and processes other than those noted could be used. Therefore, the scope of the invention is to be limited only by the following claims.

The invention claimed is:

1. A bidet system comprising:

an adaptor assembly adapted to be fluidically connected to a liquid supply;

a handle assembly fluidically coupled to the adapter assembly, the handle assembly comprising means for controlling flow of a liquid delivered by the adaptor assembly to the handle assembly, a nozzle for discharging the liquid from the handle assembly, and a handle adapted to maneuver the nozzle; and an attachment assembly adapted to mount the handle assembly to a toilet bowl and enable the nozzle of the handle assembly to be selectively axially and rotatably maneuvered about a horizontal axis within the toilet bowl with the handle.

2. The bidet system according to claim 1, wherein the adaptor assembly comprises:

means for connecting to and drawing water from a sink water system; and means for transporting water from the sink water system to the handle assembly.

3. The bidet system according to claim 1, wherein the handle assembly comprises a pipe rotatably coupled to the attachment assembly, and the nozzle is disposed at a distal end of the pipe relative to the handle.

4. The bidet system according to claim 3, wherein the nozzle does not protrude from the pipe.

5. The bidet system according to claim 3, wherein the pipe of the handle assembly is axially movable relative to the attachment assembly.

6. The bidet system according to claim 3, wherein the attachment assembly includes holes formed in a hinge member thereof, the pipe is located within the holes, the holes define a pivot axis and the pipe is free to rotate about the pivot axis.

7. The bidet system according to claim 6, wherein the pipe is axially movable along the pivot axis.

8. The bidet system according to claim 1, wherein the controlling means of the handle assembly is operable to selectively enable flow of the liquid through the handle.

9. The bidet system according to claim 1, wherein the attachment assembly comprises:

means for fixing the attachment assembly to a toilet between bowl and seat thereof; and means for mounting the handle assembly thereto and enabling the handle assembly to be moved axially and rotatably by operating the handle.

10. A method of installing the bidet system of claim 1 on a toilet, the method comprising:

fluidically connecting the adaptor assembly to hot and cold water supplies;

mounting the attachment assembly to the toilet so that the nozzle of the handle assembly is disposed within a bowl of the toilet; and fluidically connecting the handle assembly to the adaptor assembly for delivering a mixture of hot and cold water to the nozzle of the handle assembly.

11. A method of using the bidet system of claim 1, the method comprising:

manipulating the handle of the handle assembly to maneuver the nozzle within a toilet bowl of a toilet; and operating the controlling means to deliver a mixture of hot and cold water to the nozzle of the handle assembly and discharge the mixture from the nozzle into the toilet bowl.

12. The bidet system according to claim 1, wherein the handle assembly is operable to selectively control the pressure and direction of water flow from the nozzle.

* * * * *